United States Patent [19]

Tasaka et al.

[11] 4,027,588

[45] June 7, 1977

[54] CONTROL MECHANISM FOR AN OFFSET PRINTING MACHINE

[75] Inventors: Tomoyuki Tasaka; Yoshinori Honkawa, both of Hiroshima, Japan

[73] Assignee: Ryobi, Ltd., Hiroshima, Japan

[22] Filed: Jan. 22, 1976

[21] Appl. No.: 651,464

Related U.S. Application Data

[63] Continuation-in-part of Ser. No. 429,360, Dec. 28, 1973, abandoned.

[52] U.S. Cl. ..... 101/144; 101/148; 101/425

[51] Int. Cl.[2] ..... B41F 7/24; B41F 7/06; B41F 7/26

[58] Field of Search ..... 101/141, 142, 144, 145, 101/132, 132.5, 140, 148, 425

[56] References Cited

UNITED STATES PATENTS

| | | | |
|---|---|---|---|
| 3,056,346 | 10/1962 | Gammeter et al. | 101/144 |
| 3,412,676 | 11/1968 | Tonkin et al. | 101/144 |
| 3,490,367 | 1/1970 | Kaneko et al. | 101/144 |
| 3,496,864 | 2/1970 | Tonkin et al. | 101/142 |
| 3,517,613 | 6/1970 | Schinke et al. | 101/142 |
| 3,601,045 | 8/1971 | Schinke et al. | 101/144 |
| 3,702,586 | 11/1972 | Kaneko et al. | 101/142 |
| 3,731,624 | 5/1972 | Kaneko et al. | 101/142 |
| 3,771,446 | 11/1972 | Kaneko et al. | 101/144 |

*Primary Examiner*—J. Reed Fisher

[57] ABSTRACT

A control mechanism for an offset printing machine in which total printing operation is efficiently and easily carried out through a single control shaft with a knob.

The control mechanism is operative in a combination of an automatic mode and a manual mode to utilize advantages of both modes. The control shaft is rotatively constructed in such a way that its neutral position, its position for supply of ink and dampening solution to rollers, its position for transfer of ink and dampening solution to a master cylinder, its position for paper feeding and printing, its position for blanket cleaning, and its position for stopping the machine make one complete cyclic loop. The control shaft is manually rotated stepwise from its neutral position to its position for paper feeding and printing. After a preset number of sheets are printed, the control shaft is automatically rotated to its position for blanket cleaning and then to its position for stopping the machine.

16 Claims, 14 Drawing Figures

CONTROL MECHANISM FOR AN OFFSET PRINTING MACHINE

CROSS REFERENCE TO RELATED APPLICATION

This is a continuation-in-part of co-pending U.S. application Ser. No. 429,360, now abandoned filed Dec. 28, 1973.

FIELD OF THE INVENTION

This invention relates to an offset printing machine, and more particularly to a control mechanism for offset printing machines, the control mechanism being operative in a combination of an automatic mode and manual mode so as to efficiently and easily operate the printing machines.

BACKGROUND OF THE INVENTION

In conventional offset printing machine, which require several fundamental steps such as inking, dampening, paper feeding, printing, and blanket cleaning, various inventions and modifications have been made regarding mechanisms for controlling the aforementioned steps. Existing mechanisms before the present invention for controlling offset printing machines, especially in small offset printing machines suitable for business office work, are mechanically too complicated and at the same time, are cumbersome from an operator's standpoint. For example, in the mechanism shown in the U.S. Pat. No. 3,601,045, the blanket cleaning position of the control shaft is located between the original neutral position and the printing position. If there were no second neutral position, in case of any printing trouble such as paper jam, the control shaft had to be quickly shifted to the original neutral position through the blanket cleaning position, which means that the blanket surface would momentarily touch the blanket cleaning roller resulting unintentional inking on the surface of a master plate on resumption of printing. Accordingly, a second neutral position is provided before the blanket cleaning position so that in case of any printing trouble such as paper jam, the control shaft can be quickly shifted to the second neutral position without the blanket surface touching the blanket cleaning roller. Because of the existence of the second neutral position, the mechanism becomes inevitably complicated. Another example of a recent invention of control mechanism can be seen in the U.S. Pat. No. 3,731,367 and 3,731,624. In this mechanism, the blanket cleaning position of the control shaft is located beyond the original neutral position looking from the printing position of the control shaft. Because of the use of an operation lever that can not rotate 360°, it would be almost impossible to convert the mechanism so as to automatically clean the blanket after a pre-set number of sheets are printed.

The present invention provides a simplified control mechanism for easier operation.

OBJECTS OF THE INVENTION

A primary object of this invention is, therefore, to provide a control mechanism for an offset printing machine adapted to be easily operated and controlled by an operator.

A second object of this invention is to provide a control mechanism for an offset printing machine, by which handling of the machine in case of any printing trouble becomes easy and test printing also becomes easy through a combination of automatic mode and manual mode.

A third object of this invention is to provide a control mechanism for an offset printing machine in which the total printing process is governed by a single control shaft, the control shaft being rotatable 360 degree to finalize the total printing process via blanket cleaning process.

A fourth object of the invention is to provide a control shaft of an offset printing machine together with a knob of rotary type, which is simple in construction and accordingly maintenance-free.

A fifth object of this invention is to provide a control mechanism for an offset printing machine in which an automatic mode of operation and a manual mode of operation of the machine are well defined by stop means so that the manual mode of operation never disturbs any process progressing under the automatic mode of operation.

These and other objects and advantages of this invention will become apparent through a review of the attached drawings and a further reading of the specification and the claims.

SUMMARY OF THE INVENTION

The objects of this invention are achieved by providing a control mechanism of an offset printing machine in which continual steps (such as starting the machine, supplying dampening solution and ink to rollers, transferring of dampening solution and ink onto a master plate on a master cylinder, transferring ink onto a blanket on a blanket cylinder, feeding sheets and transferring ink onto sheets, completing of printing, blanket cleaning, and stopping the machine are easily controlled. Of the continual steps, the steps leading to actual transfer of ink onto sheets are manually performed, and the steps thereafter are automatically performed through the control shaft. A stop means installed in the printing machine precludes any erroneous manual operation.

DESCRIPTION OF THE PREFERRED EMBODIMENT

Figure 1:
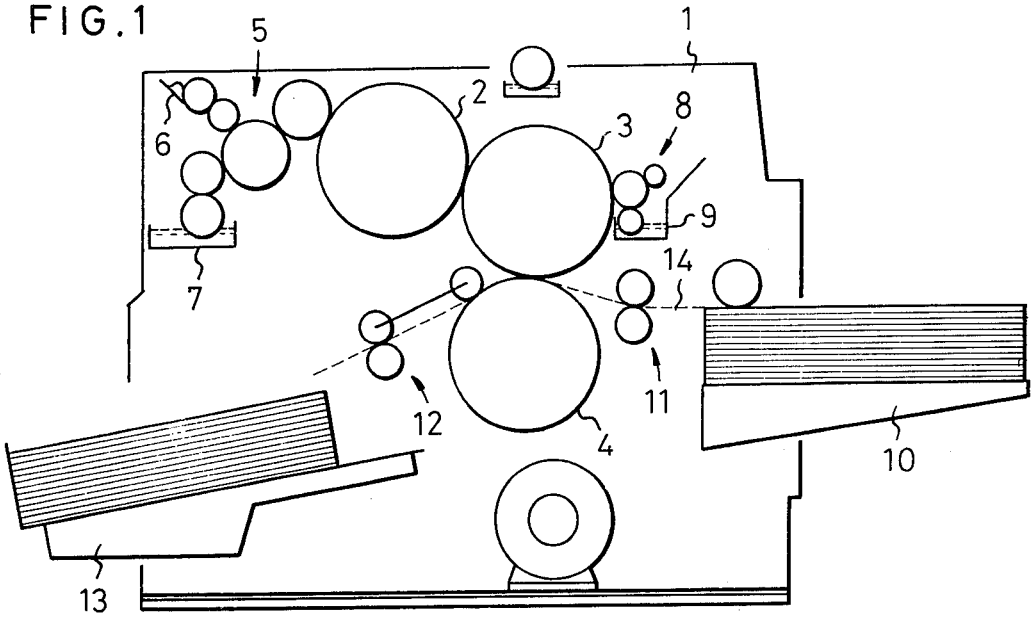
FIG. 1 shows an overall cross-sectional view of the arrangement of the cylinders and rollers of the offset printing machine and associated elements.

Referring now to the drawing in detail, and initially to FIG. 1, shown is the whole construction of the offset printing machine. The reference numeral 1 shows a frame of the printing machine, in which are operatively arranged a master cylinder 2, a blanket cylinder 3, an impression cylinder 4, an ink and dampening solution applying apparatus 5, an ink fountain 6, a dampening solution fountain 7, a blanket cleaning apparatus 8 and a tank of cleaning solution 9. A sheet of paper 14 to be printed is supplied to feeding rollers 11 and is passed between the blanket cylinder 3 and the impression cylinder 4, and then is passed between eject rollers 12. Finally, the printed sheet is placed on the receiving tray 13. The master cylinder 2 and the impression cylinder 4 respectively are supported by eccentric shafts so as to make contact with the blanket cylinder 3 as they rotate.

Figure 2:
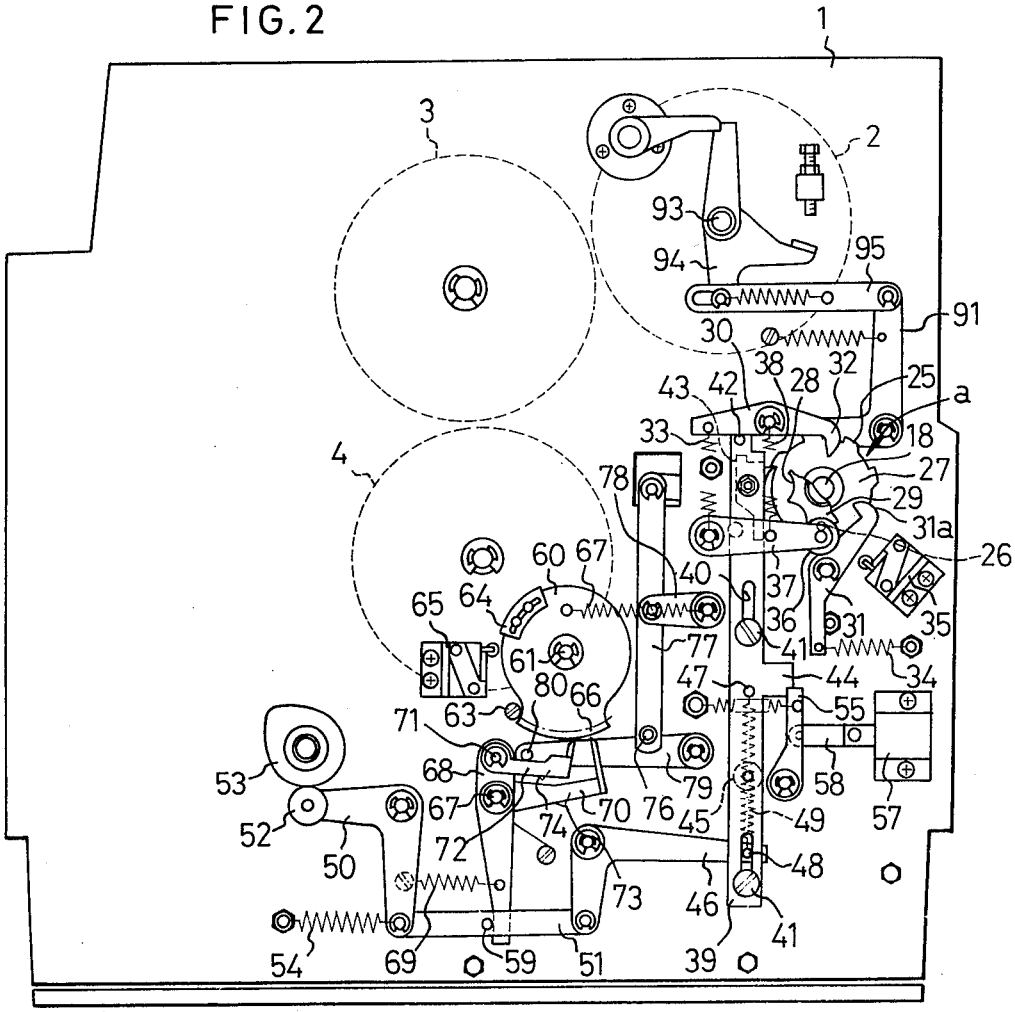
FIG. 2 is a side view showing various members of the control mechanism for the offset printing machine when the machine is stopped.
Figure 3:
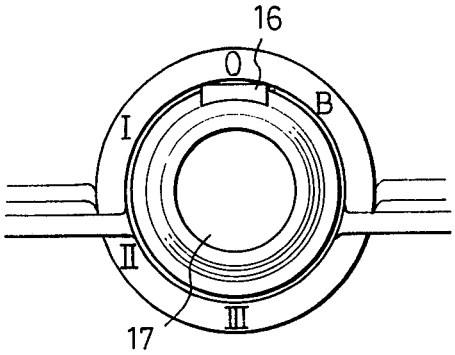
FIG. 3 is a front view of a knob to rotate a control shaft and indications of positions of the control shaft.
Figure 9:
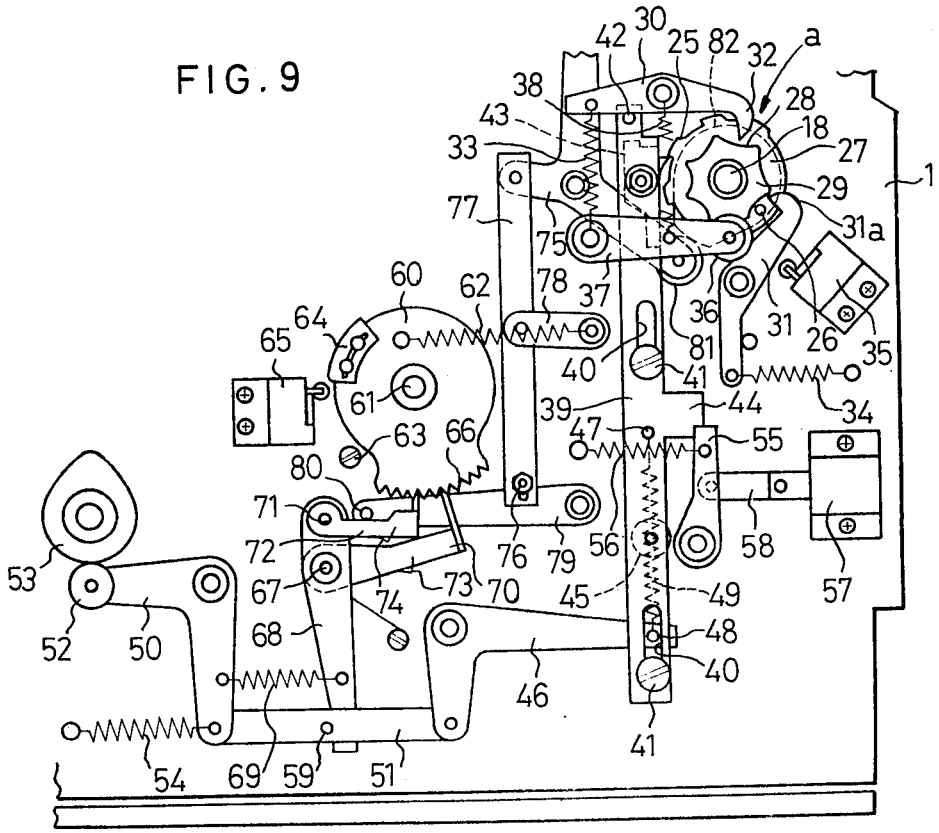
FIG. 9 shows the position of various members of FIG. 2 when the knob is situated at the position B for blanket cleaning.
Figure 10:
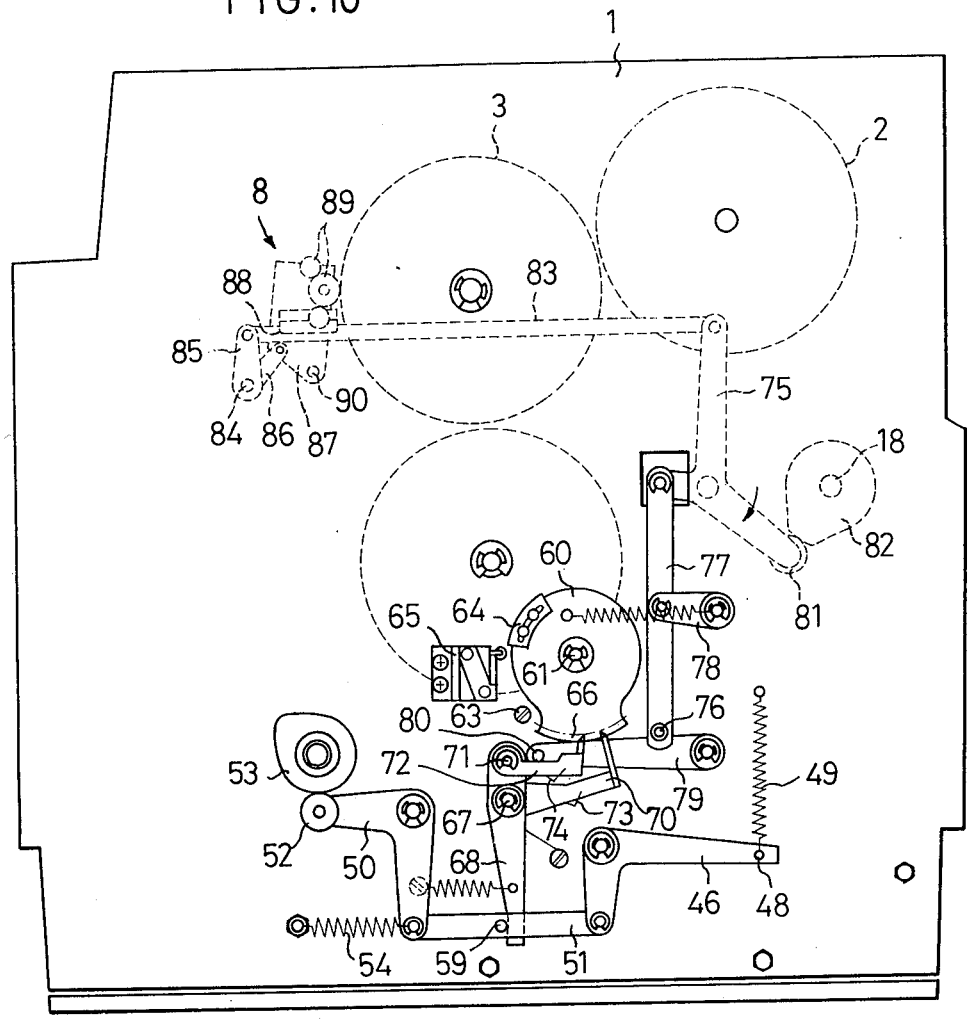
FIG. 10 is a side elevational view showing particularly the blanket cleaning apparatus and the set of cylinders.
Figure 11:
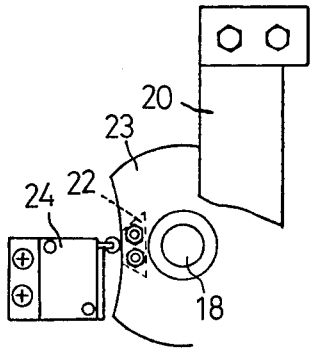
FIG. 11 is a partial front view of FIG. 4A showing an operational relation between the switch block and the microswitch.

The drawings of FIGS. 2–11 show whole construction of the control mechanism for the offset printing machine according to the present invention. As shown in FIGS. 3, 4A and 4B, a stop pin 14 on the control knob 17 extends from a bracket 16 in which a coil spring 15 is mounted and the bracket 16 is loose-fitted to the knob 17. The knob is fixed to a control shaft 18 adapted to rotate together with the stop pin 14 from the start position 0 counterclockwise as viewed in FIG. 3. The stop pin 14 is adapted to abut on the side 21 of a stop bracket 20 having a lower end 19 shaped in an arc. In this position of the stop pin 14, the knob 17 is restrained from rotating clockwise. As shown in FIG. 11, the microswitch 24 contacts a switch block 22 secured to the cam 23. The cam 23 is mounted on the control shaft 18 to rotate together with the shaft 18. The microswitch 24 operates to stop the printing machine.

Figure 8:
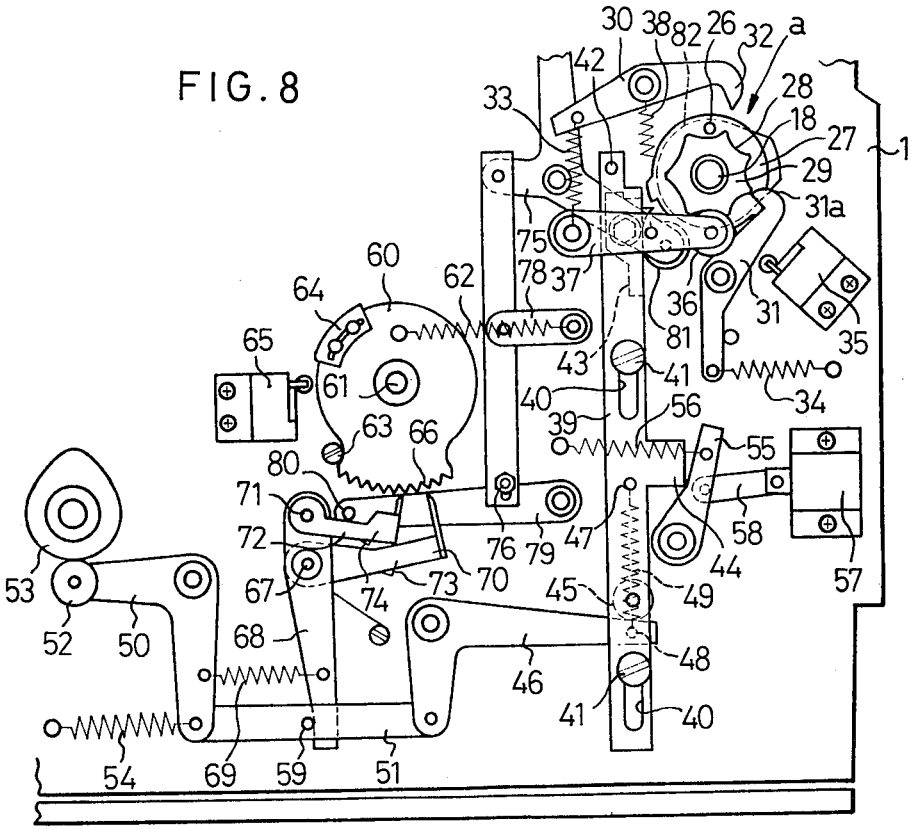
FIG. 8 shows various members of FIG. 2 at the completion of printing.
Figure 13:
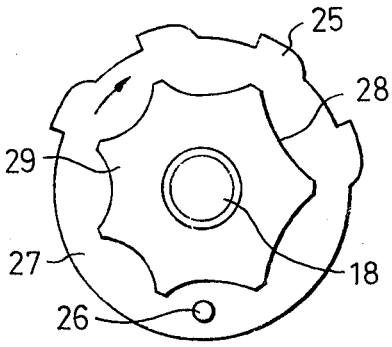
FIG. 13 is an enlarged view showing the ratchet and the star-like cam mounted on the control shaft.

The control shaft 18 has a ratchet 27 and a cam 29 at the opposite end of it, and the ratchet 27 and cam 29 are integrally secured to the opposite end so as to rotate together with the control shaft 18. As clearly shown in FIG. 13, the ratchet 27 has multiple stepped portion 25 formed around its circumference at regular distances with 45° angle to the diametral lines and also a stop pin 26 planted on its side face. The cam 29 has a multiple number of indented portions 28 formed around its circumference at distances of 45° or 60° angles to the diametral lines. The indented portions 28 engage with a roller 36 so as to correspond to the positions of the control shaft 18. The ratchet 27 and the cam 29 constitute a rotary mechanism for the control shaft 18. In relation to the rotary mechanism, a set of stoppers 30 and 31 are pivotally mounted on the machine frame 1. The stopper 30 has a bent portion 32 so that it engages with the stop pin 26 when the control shaft is set at the position III. The stopper 30 is ordinarily urged in the direction along which the engagement with the stop pin 26 is disengaged by means of a spring 33. The stopper 31 has a spring 34, so that the stopper oscillates outwardly by pressing a slanted end portion 31*a* of the stopper 31 by means of the stop pin 26 when the knob 17 rotates from the position III to the position B in order to move the stop pin 26 from the position of FIG. 8 to that of FIG. 9. After the stop pin 26 passes over the slanted end portion 31*a*, the stopper 31 returns to its original position. The microswitch 35 is functioned as shown in FIG. 9 when the stopper 31 is pressed outwardly by means of the pin 26.

An arm 37 has the roller 36 pivoted to its end and a spring 38 mounted thereon. The spring urges resiliently the arm 37 along the direction in which the roller 36 engages with the indented portions 28 of the star-shaped stop cam 29. The arm 37 holds the control shaft 18 at any suitable position.

A link 39 has slotted openings 40 within which guide pins 41 are slidingly fitted so as to allow the link 39 to move up and down. The link 39 has a stop pin 42 planted thereon at its upper end and claw 43 at its side. The claw 43 is pivoted so as to engage with the stepped portion 25 of the ratchet 27. Also, the link 39 has an engagement portion 44 extending from a side of the central portion of the link, and a roller 45 at its lower end. A L-shaped arm 46 pivoted to the frame has an end portion extended so as to engage with the roller 45 provided on the link 39. The L-shaped arm 46 and the link 39 respectively have pins 48 and 47, so that the arm 46 and the link 39 are pulled toward each other by means of a spring 49 hooked on the pins 48, 47. The arm 46 is connected to an end portion of a cam arm 50 at its another end portion through a link 51 having 59 planted thereon. The cam arm 50 has a roller 52 on another end portion thereof and constantly urged to ride on a cam 53 by means of a spring 54 expandingly mounted on the cam arm 50. The cam 53 connected to a shaft of a prime mover such as an electric motor has a high point thereon and is rotated by a prime mover or a motor of the printing machine through a gears reducer. The arm 46 oscillates when the cam 53 is rotated.

A clutch 55 has an engagement portion on its upper side and is pivoted to the frame 1. The clutch 55 has a spring 56 so that the clutch resiliently engages with the engagement portion 44 of the link 39. The clutch 55 is connected to a plunger of solenoid 57 through a link 58, so that the solenoid 57 pulls the clutch 55 through the link 58 when the solenoid is energized and disengages the clutch 55 from the engagement portion 44.

A ratchet 60 pivoted to the machine frame 1 by means of a shaft 61 has a spring 67 urging the ratchet to rotate clockwise. The ratchet 60 is generally held at the position shown in FIG. 2, in which the ratchet contacts the stop pin 63. A switch plate 64 is secured to the ratchet 60 by screws screwed through an elongated opening so as to be placed at an operative relation to the ratchet 60. When the ratchet 60 rotates counterclockwise against force of a spring 67, the switch plate 64 contacts a microswitch 65 and operates the microswitch 65. An arm 68 is pivoted to the frame 1. A spring 69 is mounted to the arm 68 so as to urge its end portion to engage with the pin 59 of the link 51. A claw 72 for moving the ratchet 60 is provided at one end of the arm 68 through a pin 71. A claw 70 is pivoted to the stud 67 for preventing reverse rotation of the ratchet.

The claws 70 and 72 respectively have springs 73 and 74 so that the claws engage with the toothed portion 66 of the ratchet 60.

As shown in FIG. 10, an arm 75 for cleaning the blanket is pivoted to the frame 1 and has three branches extending along three directions.

On a first branch of them, a link 77 having a pin 76 planted at its lower end is connected so that the link 77 may shift up and down according to the rocking movement of the arm 75. A short arm 78 pivoted to the frame 1 supports the middle portion of the link 77 for securing vertical movement of the link. An arm 79 has an end portion pivoted at the frame 1 and another end portion having a pin 80 planted thereon. At all positions of the control shaft 18, except for the position corresponding to the blanket cleaning, the arm 79 touches the pin 76, and is pressed downward. Accordingly, the claw 72 is pressed downward against force of the spring 74 and the claw 70 is also pressed downward through a head of claw 72. As a result, the claws 70, 72 are kept disengaged from the toothed portion 66 of the ratchet 60. A second branch of the arm 75 has a rolller 81, and the roller 81 constantly contacts a cam 82 having a high point and secured to the control shaft 18. A third branch of the arm 75 is connected to the blanket cleaning apparatus 8 through a link 83.

As shown in FIG. 10 in the blanket cleaning apparatus 8, an arm 85 is secured through its end portion to an eccentric shafts 84 mounted on the frame 1, and another end portion of the arm 85 is connected to the link 83. An end portion of the arm 86 is loosely fitted to the eccentric shaft 84. The another end of the arm 86 is connected to the securing plate 87. A tank 88 of cleaning solution 9, having cleaning rollers is mounted on the securing plate 87. The securing plate 87 is pivoted at an a stud 90. As the roller 81 of the arm 75 for blanket cleaning is placed on the land of cam 82, the arm 75 shifts clockwise in order to rotate the securing plate 87 around the stud 90 toward the blanket cylinder 3 through the link 83, the arm 85, the eccentric shaft 84 and the arm 86. Thus, the roller 89 is pressed to the blanket on the blanket cylinder 3.

The mechanism for contacting and detaching the master cylinder to the blanket cylinder is shown in FIG. 2. An arm 91 pivoted on the frame 1 is constantly contacted to a cam (not shown) which has a high point and secured to the control shaft 18, by means of a spring (unnumbered). Another end portion of the arm 91 is connected to an arm 94 by a link 95. When the knob 17 is placed at the position III, the arm 91 oscillates by the unshown cam and subsequently the eccentric shaft 93 is rotated by a link 95 and an arm 94 to contact the master cylinder to the blanket cylinder.

Figure 12:
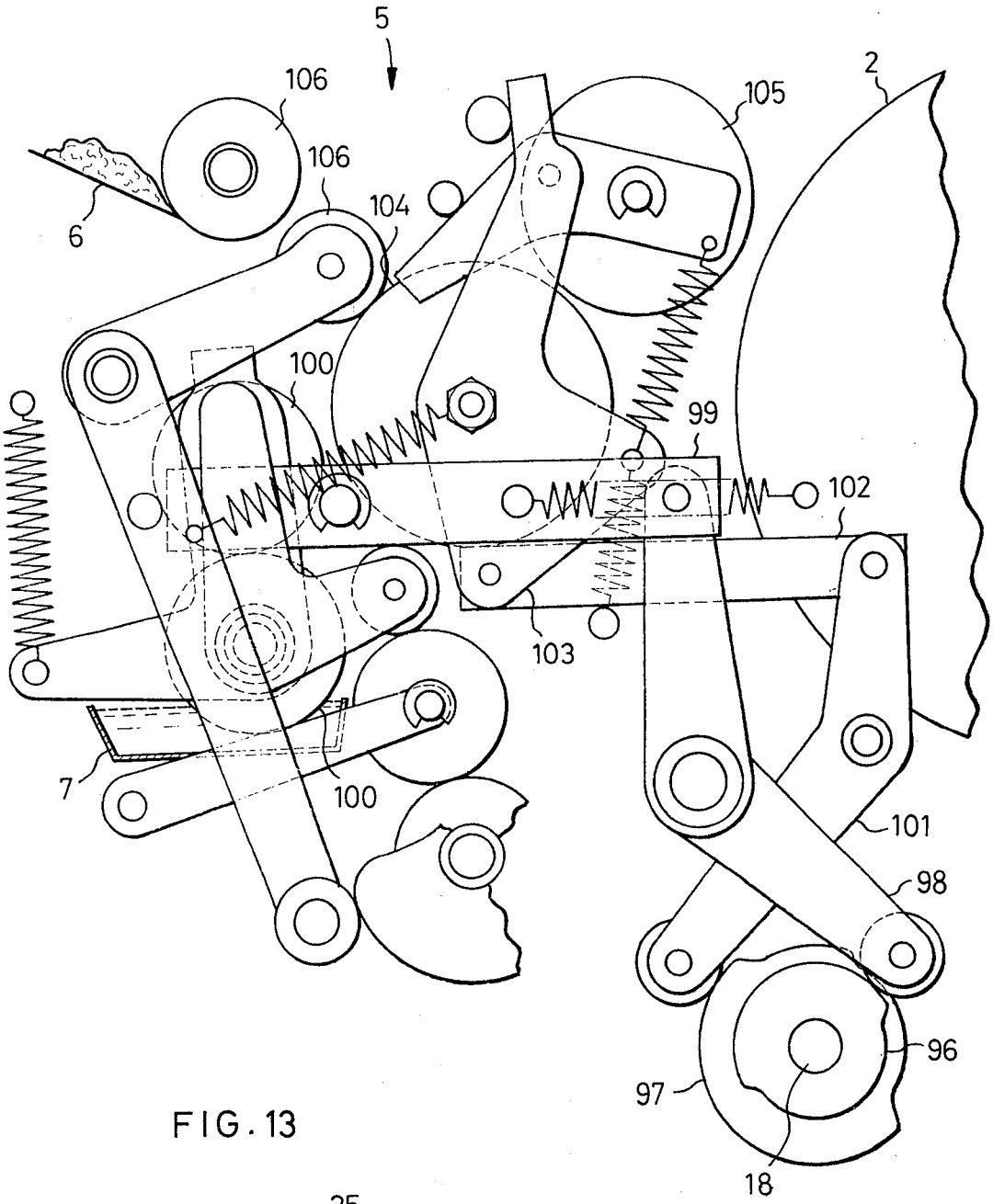
FIG. 12 is a side view showing an operational relationship of the control shaft with dampening and inking mechanism.

The linking and dampening apparatus, as shown in FIG. 12, has a cam 96 and a cam 97. The cams 96 and 97 are fixed on the control shaft 18. The cam 96 has a indented portion on its periphery and the cam 97 has two indented portions along its periphery. A water ductor roller 100 and ink ductor roller 106 are connected to the cam 96 through an arm 98 and a link 99. A form roller 105 is connected to the cam 97 through an arm 101, a link 102 and an arm 103. With the knob 17 at the position 0, the ink ductor roller 106 and the water ductor roller 100 stop to duct and the form roller 105 is separated from the oscillating roller 104. With the control shaft 18 at the position 1, the ink ductor roller 106 and the water ductor roller 100 begin to duct, and the form roller 105 is pressed to the oscillating roller 104, thus dampening solution and ink are supplied to the form roller 105. With the control shaft 18 at the position 11, the form roller is pressingly contacted to the master cylinder 2 in order to supply water and ink to the cylinder.

As the master cylinder 2 makes contact with the blanket cylinder 3, the sheet feeding operation is started and simultaneously a conventional sheet detecting device operates. Then, a conventional impression cylinder functioning mechanism operates to bring the impression cylinder into its printing position. A sheet counter (not shown) is provided in the printing machine, on which a desired number is to be set prior to printing. The sheet counter starts its counting operation as another first sheet is fed. The sheet counter has a microswitch (not shown) electrically connected to the solenoid 57. The solenoid 57 is also connected to the microswitches 35, 65 through an electric circuit.

The printing operation of the printing machine at various positions of the knob 17 will be explained as follows:

With the knob 17 at the position O, the master cylinder 2 and the impression cylinder 4 are respectively separated from the blanket cylinder 3, and the control mechanism for the printing machine is placed as shown in FIG. 2. In this position, the stop pin 26 is located at the bottom. Any operation of the main switch (not shown) by an operator does not start the printing machine unless the sheet counter indicates some non-zero number.

In order to start an operation of the printing machine, the knob 17 is turned from the position O to the position I, resulting in contact of the ink ductor roller 106 and the water ductor roller 100 in FIG. 12 with the oscillating roller 104, and in contact of the roller 104 with the form roller 105 by means of the cams 96, 97 of the control shaft 18. Therefore, ink and dampening solution are supplied to the form roller 105.

When the knob 17 is turned from the position I to position II, the form roller 105 is contacted with the surface of the master cylinder 2 through the arm 101 and the link 102 respectively functioned by two indented portions of the cam 97 in order to supply dampening solution and ink onto the master cylinder. Next, the knob 17 is rotated to the position III, then a locking arm (unnumbered) is rotated by the rotation by cylinder 2, and the arm 91 is oscillated from the position shown in FIG. 2 toward the right by an extended portion of the master cylinder engagement cam 92 (not shown) secured to the control shaft 18, the arm 94 oscillates through the link 95 in order to rotate the eccentric shaft 93 and to make the master cylinder 2 contact the blanket cylinder 3.

Figure 5:
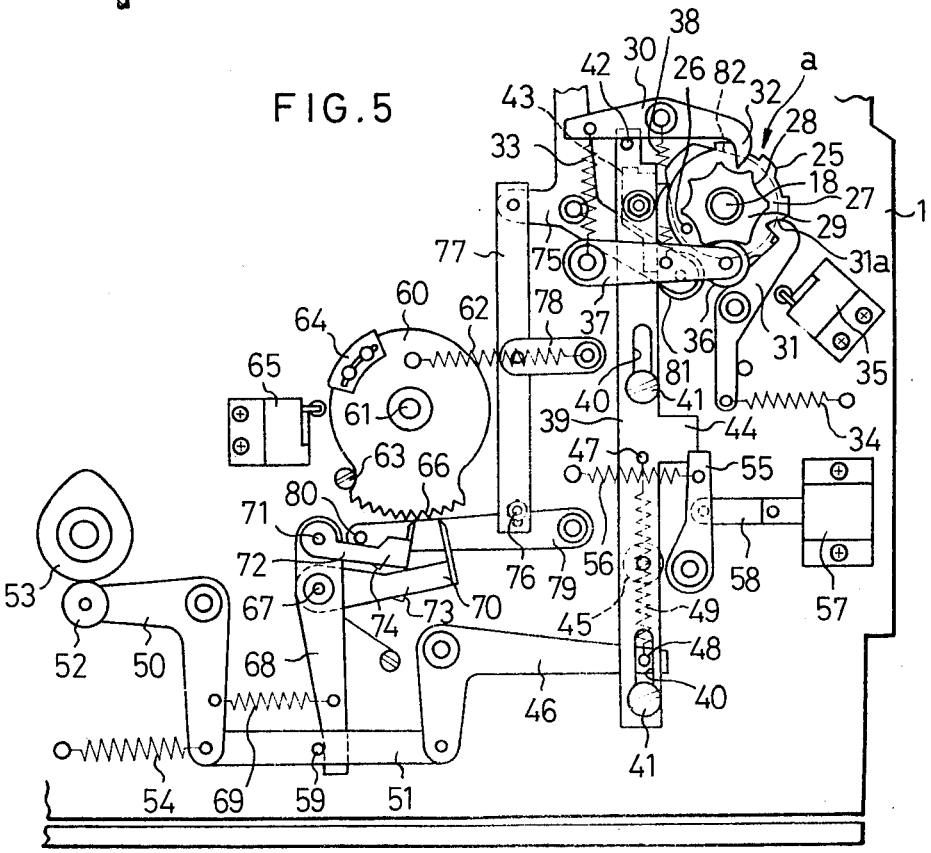
FIG. 5 is a view of FIG. 2 showing the various members when the knob is situated at the position I of the control shaft, which is for supply dampening solution and ink onto the rollers.
Figure 6:
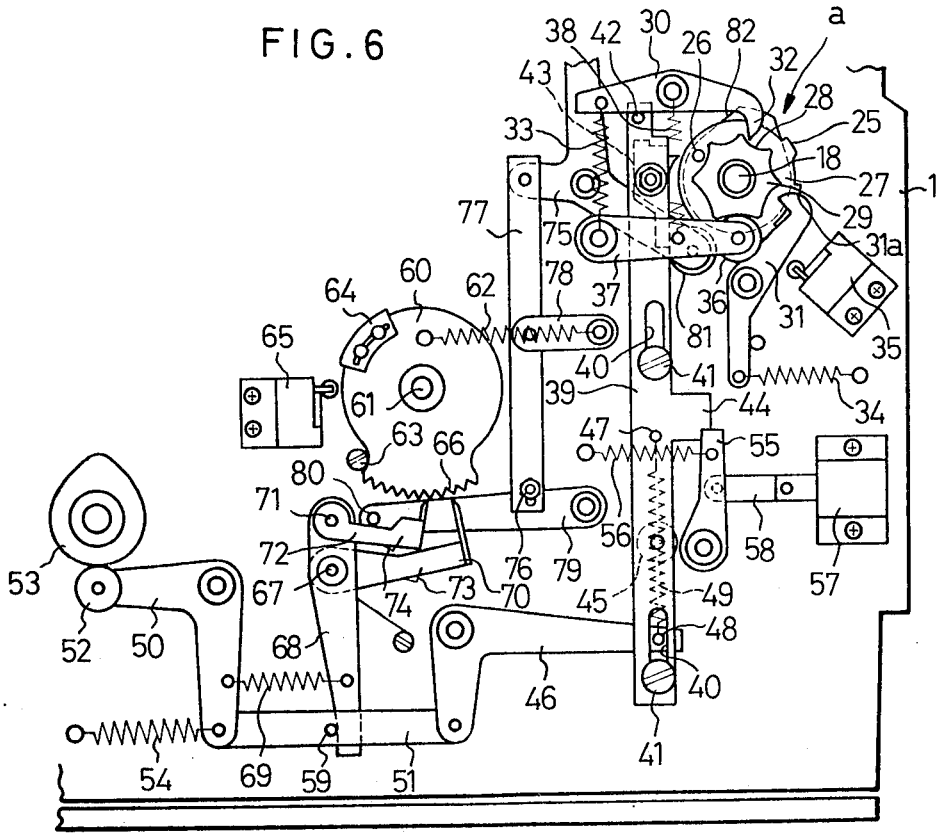
FIG. 6 shows various members of FIG. 2 with the knob situated at the position II, which is for transfer of ink onto a master plate on a master cylinder.

The stop pin 26 extending from the ratchet 27 is located at the positions shown in FIGS. 5, 6 and respectively as the knob 17 is rotated to the positions I, II and III. When the knob 17 is placed at the positions O, I, II, and III, the solenoid 57 is de-energized and the clutch 55 is pulled by a spring 56 so as to engage with the engagement portion 44. As a result, the link 39 is kept at its elevated position and the stopper 30 is kept at its horizontal position by a pin 42. At this time the arm 75 is kept in contacting condition with an indented portion of the cam 82 secured to the control shaft 18, so that the link 77 is located at its descended position to press down the arm 79. Then, the ratchet feeding claw 72 and the stopping claw 70 are placed at their pressed-down positions and are separated from the toothed portion 66 of the ratchet 60.

Figure 7:
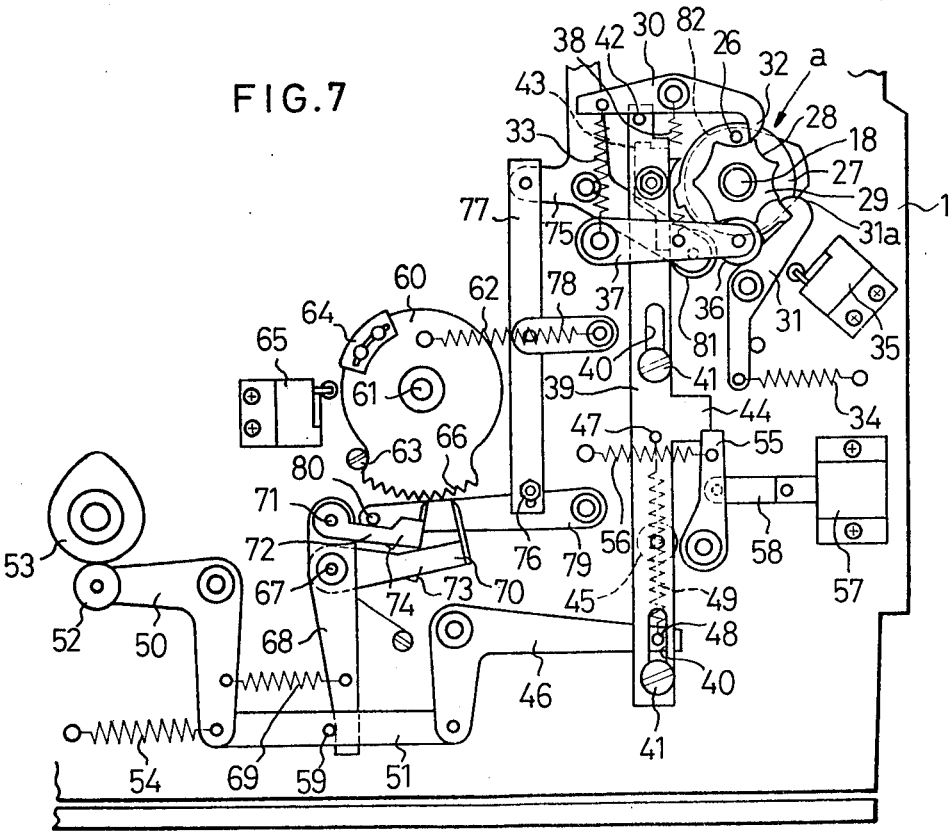
FIG. 7 shows various members of FIG. 2 witg the knob at the position III of printing.

With the knob at the position III, the stop pin 26 engages with the stopper 30 as shown in FIG. 7, and accordingly the control shaft 18 is prevented (from rotating clockwise from the position III to position B). When the knob 17 is rotated to the position III, the sheet feeding apparatus II is functioned to start sheet feeding operation and the impression cylinder 4 contacts with the blanket cylinder 3 by operation of the aforementioned impression cylinder engagement mechanism. The machine starts to print and the sheet counter begins to count at the position III. During the printing process, the cam 53 is kept rotating and the arm 46 oscillates through a cam arm 50 and a link 51, and therefore the end portion of the arm 46 oscillates up and down without any influence of the roller 45 of the link 39.

Test printing of the offset printing machine is manually carried out by rotating the knob 17 from its position O to position III. In case of a printing trouble such as paper jam at the position III of printing condition of the machine, the knob 17 is manually rotated reversely from the position III to the position O through the positions II, I. At the position O, the main switch is turned off in order to rectify the printing machine.

When the printing operation is completed without any trouble, the sheet counter (not shown) shows 0. Then, a microswitch operatively connected to the sheet counter is actuated and the solenoid electrically connected to the microswitch is energized, so that the clutch 55 is pulled to the right against force of the spring 56 as shown in FIG. 8. As a result, the link 39 is disengaged from the clutch 55, and the link 39 descends slowly, guiding the pins 41 sliding through the long opening 40 by force of a spring 49 extended between a pin 48 provided at an end of the arm 46 and a pin 47 provided on the link 39. The link 39 descends together with a stop pin 42 and the claw 43 so as to disengage the stopper 30 of the pin 26 and oscillate the stopper 30 by force of a spring 33, thus the stop pin 26 is brought to a disengaged condition.

The link 39 is raised by a roller 45 when the end portion of the arm 46 oscillating through the cam 53 contacts the roller 45. The pawl 43 is raised together with the link 39 and then the claw 43 engages with the stepped portion of the ratchet 27 in order to rotate the ratchet 27 moving the pin 26 to the right. Because the ratchet 27 is rotated before the pin 42 and the stopper 30 are engaged, the stopper 30 does not engage with the pin 26.

Figure 4A:
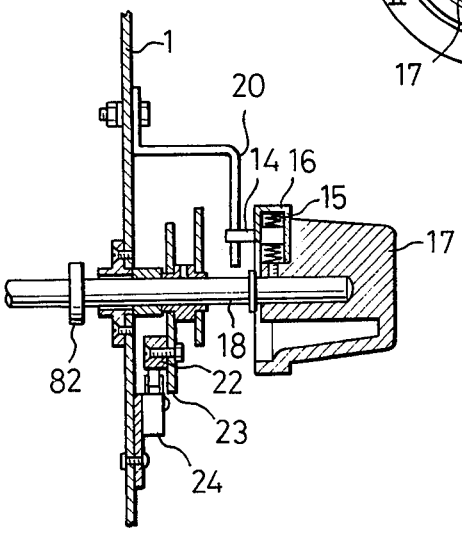
FIG. 4A is a sectional side view showing a microswitch and a switch block to stop the machine.
Figure 4B:
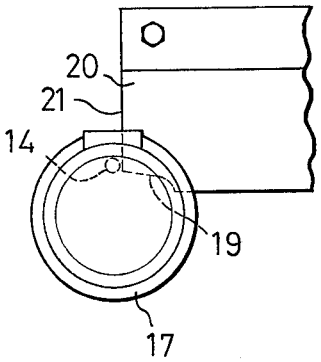
FIG. 4B is a front view showing the relation of a stopper bracket and a stop pin.

When the ratchet 27 rotates clockwise by repeated up-and-down motion of the link 39, the pin 26 on the ratchet 27 moves a suitable angle at a time and the control shaft 18 moves from the position III to position B and finally the pin 26 abuts on a slanted surface 31*a* of the stopper 31. Then, the stopper 31 is escapes outward when the stopper 31 is pressed by the stop pin 26, thus the pin 26 can move to the position B as shown in FIG. 9. At this time, the stopper 31 abuts on the microswitch 35 in order to operate the microswitch 35 and de-energize the solenoid 57 electrically connected to the microswitch 35. The clutch 55 is pulled by means of a spring 56 in order to lock the engagement portion 44 and to keep the link 39 at its raised position. Simultaneously, the arm 75 oscillates to the right in FIG. 10 by the extended portion of the cam 82 fixed on the control shaft 18 in order to raise the link 77. Then, the arm 79 becomes free of a pin 76 to release the claws 70, 72 from their down-pressed condition by the pin 80 of the arm 79, thus the claws 70, 72 engage with the toothed portion 66 of the ratchet 60 by force of springs 73, 74. In this engagement condition, the cam 53 is continued in its rotary motion and the claw moving arm 68 is engaged with the pin 59 of the link 51 so as to oscillate around the stud 67. The claw 72 feeds one tooth at a time of the ratchet in order to rotate the ratchet counterclockwise. Then, the claw 70 for preventing reverse rotation of ratchet follows the rotation of the ratchet 60 against the resilient force of the spring 73 and engages with one tooth at a time of the toothed portion 66 in order to prevent the ratchet from reverse rotating. Owing to the afore-described oscillating motion of the arm 75, the roller 89 of the blanket cleaning apparatus 8 connected to the eccentric shaft 84 is impressed through a link 83 to the blanket cylinder 3. While the claw 72 engages with the toothed portion 66 of the ratchet 60, the blanket is cleaned and the cleaning operation is continued. As the ratchet 60 is rotated by the claw 72, the switch plate 64 is moved together with the ratchet plate 60 and abuts against the microswitch 65 in order to close it. Accordingly, the solenoid 57 is energized to pull the clutch 55 in order to release the link 39. Thus, the link 39 starts its up and down motion in order to rotate the ratchet 27 and rotate the knob 17 to its neutral position O. At this time, the pin 26 returns to the original position shown in FIG. 2. Also the cam 92 and arm 75 return to their original position, by which the roller 89 of the blanket cleaning apparatus is separated from the blanket cylinder 3. Then, the link 77 descends to press down the arm 79, thus disengaging the claws 70, 72 from the toothed portion of the ratchet 60. The ratchet 60 rotates clockwise by force of the spring 67 and abuts against the is stopper pin 63 and stopped at the position O of the knob 17 as shown in FIG. 2. When the knob 17 is returned to the position O, the microswitch 24 shown in FIG. 4A is abutted against the switch plate 22 and the microswitch is closed, and accordingly the solenoid 57 is de-energized. Then the clutch 55 engages with the engagement portion 44 and stops the up and down motion of the link 39. At the same time, the main switch of the printing machine is turned off and all functions of the machine are stopped.

In order to adjust the time duration of the blanket cleaning operation, the location of the switch plate 64 on the ratchet 60 can be shifted through its slotted hole.

The operational relationship of the ratchet 60, the microswitches 24, 35 and 65, the microswitch incorporated in the sheet counter and the solenoid 57 will be explained as follows:

When the sheet counter shows O and the microswitch connected to the counter is operated, the solenoid 57 is energized and the clutch 55 is separated from the engagement portion 44 of the link 39 so as to move the link 39 up and down by the cam 53, resulting in the stepped portion 25 of the ratchet 27 fixed to the control shaft 18 being fed twice 45° at a time. When the ratchet 27 is fed at the third time, the pin 26 provided on the ratchet 27 releases the stopper 31 and makes contact with the microswitch 35 installed at the side of the stopper 31. As a result, the solenoid 57 is de-energized and the clutch 55 engages with the engagement portion 44 of the link 39, so that the up and down motion of the link 39 is stopped and the feeding motion of the ratchet cause by the claw 43 is stopped, the extruded portion of the cam 82 fixed on the control shaft 18 oscillates the arm 75 in order to raise the link 77.

Then, the claws 72 and 70 are released from their down pressed condition by means of a pin 80 provided on an end portion of the claw releasing arm 79, and the claws 70, 72 are engaged with the ratchet 60 by means of the springs 73, 74. The ratchet 60 is fed by the feeding claw 72 which is mounted at the end portion of the arm 68 oscillating by the pin 59 provided at the link 51 and the ratchet 60 is prevented from reverse rotation by the stop claw 70.

When the switch 64 provided on the ratchet 60 operates the microswitch 65, the solenoid 57 is energized and the link 39 is released to descend. When the link 39 raises, the ratchet 27 is rotated an angle of 45°. Thus, the knob 17 is backed to the position O and the solenoid 57 is de-energized by the microswitch 24.

The arc portion 19 of the stopper bracket 20 does not prevent the stop pin 14 of the knob 17 from relating from the position B to position O but prevent the stop pin from rotating along the reverse direction. When the bracket 16 is pressed down to descend the stop pin 14, it is disengaged from the side end 21 of the stopper bracket 20. Thus, it is possible to manually rotate the knob 17 from the position O to position B clockwise to clean the blanket. The return movement of the knob 17 from the position B to position O counterclockwise is easily carried out manually as well as automatically, because the arc portion 19 of the bracket 20 guides the stopper pin 14 and it is not necessary to push down the bracket 16.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. An improvement in a control mechanism for an offset printing machine having:

a machine frame and a drive motor;

a master cylinder adapted to hold a plate thereon, a blanket cylinder, cooperating with said master cylinder and an impression cylinder cooperating with said blanket cylinder, said cylinders being rotatably mounted on said frame;

inking and dampening means cooperating with said master cylinder and coupled to said frame;

a control shaft rotatably mounted on said frame;

a plurality of cams supported by said control shaft;

means for moving said master cylinder and said inking and dampening means, into and out of cooperation with their respective cylinders, said means for moving being coupled to respective ones of said plurality of cams; and a control knob coupled to said shaft in order to rotate said shaft, said knob having at least neutral, printing and blanket cleaning positions;

said improvement comprising:

means for controlling the rotating movement of said control shaft comprising a first ratchet coaxially mounted on said shaft, a stop pin planted on and projecting from a side face of said first ratchet, first and second stoppers pivotally mounted on said frame and swingably engageable with said stop pin, said first stopper preventing said control shaft from manually operated reverse rotation and said second stopper preventing said shaft from manually operated progressive rotation, a star-like cam coaxially mounted on said control shaft so as to integrally rotate with said ratchet and having indented portions formed on its circumference, and a stop arm pivotally mounted to said frame and having a roller at one end thereof, said roller being in engagement with said indented portions of said star-like cam;

transmission means for transmitting the cyclical output of said drive motor of the machine to said first ratchet, and comprising an output cam, a vertically movable link having a claw pivoted thereon so as to engage with the teeth of said first ratchet and to rotate the first ratchet by an amount corresponding to one of said teeth at a time and also having a projection formed on its middle portion, and a first link mechanism for connecting said output cam to said movable link;

means for controlling said transmission means, comprising a clutch pivotally coupled to said frame and swingably engageable with said projection of said movable link, microswitches, and a solenoid energized by a preselected combination of conditions of said microswitches and connected to disengage said clutch;

means for setting the time of blanket cleaning, comprising a ratchet tooth feeding arm pivotally coupled to said frame and swinging in association with said first link mechanism, a feed claw pivotally coupled to one end portion of said ratchet tooth feeding arm, a stop claw pivotally mounted to said ratchet tooth feeding arm, a second ratchet pivotally mounted to said frame and engageable with said feed claw and said stop claw to rotate said second ratchet, and a switch plate mounted on said second ratchet and engageable with one of said microswitches; and means for controlling blanket cleaning, comprising a further cam for actuating blanket cleaning coaxially mounted on said control shaft, a claw releasing arm pivotally coupled to said frame and having an engaging pin at one end thereof for controlling the engagement of said feed claw and said stop claw with said second ratchet, and a second link mechanism for connecting said blanket cleaning cam to said claw releasing arm, thereby the first link mechanism actuated by the output cam controls both the rotation of the control shaft and the time of blanket cleaning.

2. The improvement in a control mechanism as claimed in claim 1, wherein said vertically movable link further includes a pin planted on the upper end thereof and engageable with said second stopper to swing said second stopper.

3. The improvement in a control mechanism as claimed in claim 1, wherein said first link mechanism comprises a cam following arm pivotally coupled to said frame, a roller mounted on one end of said cam following arm riding against said output cam, an L-shaped arm pivotally coupled to said frame, one end of said arm being connected to said vertically movable link through a spring, a horizontally movable link connected at both ends thereof to the other ends of said cam following arm and said L-shaped arm, and a driving pin plated on and projecting from the side face of said horizontally movable link.

4. The improvement in a control mechanism as claimed in claim 1, including a sheet counter, and wherein one of said microswitches is incorporated in said sheet counter, said microswitch energizing said solenoid to release said clutch from the engagement with said vertically movable link when said sheet counter shows zero.

5. The improvement in a control mechanism as claimed in claim 1, wherein another of said microswitches is mounted on said frame adjacent said first stopper, said another microswitch being actuated by said first stopper and de-energizing said solenoid to cause said clutch to engage with said vertically movable link.

6. The improvement in a control mechanism as claimed in claim 1, wherein still another of said microswitches is mounted on said frame adjacent said second ratchet, said still another microswitch being actuated by said switch plate and energizing said solenoid is release said clutch from the engagement with said vertically movable link.

7. The improvement in a control mechanism as claimed in claim 3, wherein said ratchet tooth feeding arm has one end engaging with said driving pin of said horizontally movable link thereby to rock itself when said driving pin is moved along with said horizontally movable link.

8. The improvement in a control mechanism as claimed in claim 1, including a first spring, and wherein said feed claw is positioned at a movable free end of said ratchet tooth feeding arm, said feeding claw being elastically urged toward said second ratchet by means of said spring.

9. The improvement in a control mechanism as claimed in claim 1, including a stop claw spring, and wherein said stop claw is positioned at the pivot point of said ratchet tooth feeding arm, said stop claw being urged toward said second ratchet by means of said stop claw spring.

10. The improvement in a control mechanism as claimed in claim 1, wherein said switch plate includes an elongated opening along which said switch plate can be adjustably mounted to said second ratchet so as to adjust the time of blanket cleaning.

11. The improvement in a control mechanism as claimed in claim 1, including a ratchet spring, and wherein said second ratchet is urged in certain rotational direction by means of said ratchet spring.

12. The improvement in a control mechanism as claimed in claim 1, wherein said second link mechanism comprises an arm having three branches thereon and pivotally coupled to said frame, a vertical link having one end connected to a first branch of said arm and another end provided with a pin abutting against said claw releasing arm, a roller mounted to the end of a second branch of said arm and riding against said blanket cleaning cam, a link connecting the blanket cleaning means to a third branch to said arm, and an arm pivotally coupled to said frame and supporting the middle portion of said vertical link for securing vertical movement of said vertical link.

13. The improvement in a control mechanism as claimed in claim 1, further including a means for preventing said control shaft from rotating reversely, said means comprising a stopper bracket fastened to said frame adjacent said knob, a bracket button included in said knob, a spring included in said bracket button and elastically urging said bracket button outwardly in the radial direction of said knob, and a stop pin being integral with and projecting from said bracket button.

14. The improvement in a control mechanism as claimed in claim 13, wherein said stopper bracket has a lower end shaped in an arc.

15. The improvement in a control mechanism as claimed in claim 14, wherein one end of said arc is positioned inside of the circle track of said stop pin and another end of said arc is positioned outside of said circle track.

16. The improvement in a control mechanism as claimed in claim 1, further including an automatic stop means comprising a further microswitch mounted on said frame and a switch block fastened to a cam mounted on said control shaft for actuating said further microswitch.

* * * * *